United States Patent [19]

Yoshida

[11] Patent Number: 4,708,173

[45] Date of Patent: Nov. 24, 1987

[54] METHOD AND APPARATUS FOR CONTROLLING WEFT DETECTION ON A FLUID JET LOOM

[75] Inventor: Toshio Yoshida, Kanazawa, Japan

[73] Assignee: Tsudakoma Kogyo Kabushiki Kaisha, Japan

[21] Appl. No.: 875,488

[22] Filed: Jun. 18, 1986

[30] Foreign Application Priority Data

Jun. 18, 1985 [JP] Japan ..... 60-133507

[51] Int. Cl.[4] ..... D03D 51/34

[52] U.S. Cl. ..... 139/370.2

[58] Field of Search ..... 139/336 R, 370.1, 370.2, 139/452; 66/163; 250/559, 562; 340/675, 677

[56] References Cited

U.S. PATENT DOCUMENTS

| | | | |
|---|---|---|---|
| 4,082,119 | 4/1978 | Washino | 139/370.2 |
| 4,384,596 | 5/1983 | Brouwer et al. | 139/370.2 |
| 4,396,040 | 8/1983 | Brouwer | 139/370.2 |
| 4,573,499 | 3/1986 | Sugita et al. | 139/370.2 |

*Primary Examiner*—Henry S. Jaudon

*Attorney, Agent, or Firm*—Lerner, David, Littenberg, Krumholz & Mentlik

[57] ABSTRACT

In construction of a fluid jet loom equipped with a free weft exchanger and a weft feeler, a weft detection circuit connected to the weft feeler is provisionally disenabled over a predetermined number of picks after every weft exchange and allows continued weft insertion even in case of faulty weft insertion in order to keep high running efficiency of the loom as long as the extent of weaving defect is within a tolerable extent.

5 Claims, 3 Drawing Figures

METHOD AND APPARATUS FOR CONTROLLING WEFT DETECTION ON A FLUID JET LOOM

BACKGROUND OF THE INVENTION

The present invention relates to method and apparatus for controlling weft detection on a fluid jet loom, and more particularly relates to method and apparatus for carrying out control on weft detection right after every weft exchange on a fluid jet loom equipped with a free weft exchanger which carries out weft insertion in accordance wth a given weft selection pattern.

In general on a fluid jet loom equipped with such a free exchanger, weft insertions at the first and following several picks are quite unstable and tend to cause unnecessary stoppage of the loom on detection of such unstable weft insertions.

Such troubles are caused by weft slippage due to abrupt starting of a weft reservoir in turn. The troubles are further caused by a fact that a weft long caught by a clamper, which is located upstream of a main nozzle, can hardly be delivered smoothly due to clinging to the clamper. In the case of a water jet loom, a main nozzle in rest does not initiate its ejection until right before weft exchange and no water exists in the main nozzle. As a consequence, no sufficient ejection of water is obtained as weft insertion of the first pick right after the weft exchange and such insufficient ejection tends to allow undesirable whipping of the leading end of the weft under insertion, thereby causing faulty weft insertion.

When a loom is stopped on detection of faulty weft insertion right after every weft exchange, running efficiency of the loom is lowered considerably. When the extent of a weaving defect caused by faulty weft insertion is within a tolerable limit, it is generally better to continue running of the loom in order to keep high running efficiency of the loom.

SUMMARY OF THE INVENTION

It is the object of the present invenion to raise running efficiency of a loom without stoppage even when weft exchange is followed by faulty weft insertions over several picks.

In accordance with the basic concept of the present invention, a weft detection circuit is provisionally disenabled when a faulty weft insertion or insertions are detected within the period of one to two picks right after every weft exchange, thereby allowing continued weft insertion. To this end, the weft detection circuit is accompanied with a detection interceptor circuit which provisionally disenables detection on receipt of a weft selection signal put out by a weft selection circuit.

DESCRIPTION OF THE PREFERRED EMBODIMENTS

Figure 1:
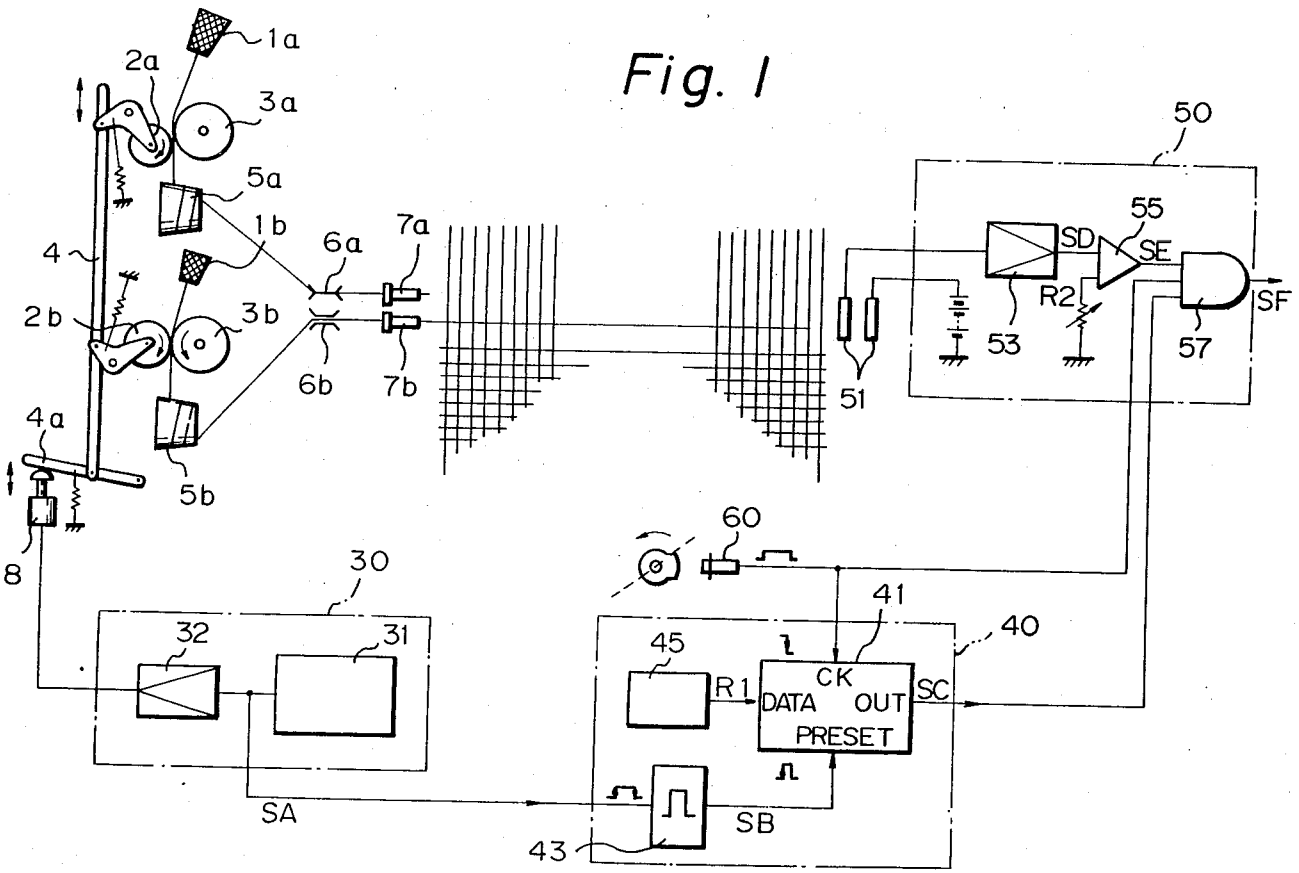
FIG. 1 is a schematic view of one embodiment of the apparatus in accordance with the present invention.

On the example of the loom shown in FIG. 1 alternate weaving with two different wefts is carried out. One weft from a supply source 1*a* is passed to a reservoir drum 5*a* via a nip roller 2*a* and a feed roller 3*a* and, after delivery from the reservoir drum 5*a*, is passed to a main nozzle 7*a* via a clamper 6*a*. In a same way, the other weft from a supply source 1*b* is passed to a reservoir drum 5*b* via a nip roller 2*b* and a feed roller 3*b* and, after delivery from the reservoir drum 5*b*, is passed to a main nozzle 7*b* via a clamper 6*b*. The nip rollers 2*a* and 2*b* are linked to a common selection rod 4 which is operated via a lever 4*a* by a solenoid 8.

The electronic part of the apparatus includes a weft selection circuit 30, a detection interceptor circuit 40 and a weft detection circuit 50 connected to each other.

The weft selection circuit 30 includes a controller 31 which generates a weft selection signal to control operation of the nip rollers 2*a* and 2*b* in accordance with preset pattern, and a solenoid driver 32 which drives the solenoid for operation. When a weft selection signal SA of, for example, level "H" is issued by the controller 31, the solenoid driver 32 urges the solenoid 8 to push up the lever 4*a* so that the selection rod 4 should move upwards. Then the nip roller 2*b* is brought into surface contact with the feed roller 3*b* so that weft insertion should be carried out by the main nozzle 7*b*. When a weft selection signal SA of, for example, level "L" is issued by the controller 31, the solenoid driver 32 urges the solenoid 8 to pull down the lever 4*a* so that the selection rod 4 should move downwards. The nip roller 2*b* is brought out of the surface contact with the feed roller 3*b* and, conversely, the nip roller 2*a* is brought into surface contact with the feed roller 3*a* so that weft insertion should now be taken over by the main nozzle 7*a*. Though not shown in the illustration, the clampers 6*a*, 6*b* and the main nozzles 7*a* and 7*b* are also selectively driven for operation by typical circuit control and operating means in response to the above-described weft selection signal SA. The weft exchange mechanism to be employed is not limited to the illustrated example.

The detection interceptor circuit 40 includes a preset counter 41 of, for example, a down-type, a one-shot multivibrator 43 and an interlock setter 45. When the weft selection signal SA is put in, the one-shot multivibrator 43 detects rise and fall of the signal and issues a one-shot signal SB to be passed to the preset counter 41.

Figure 2:
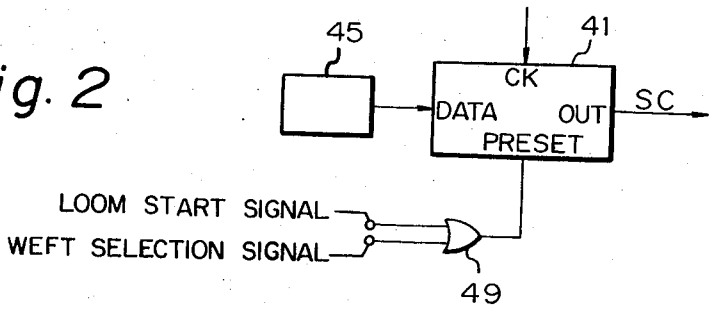
FIG. 2 is a block diagram of another embodiment of the apparatus in accordance with the present invention.
Figure 3:
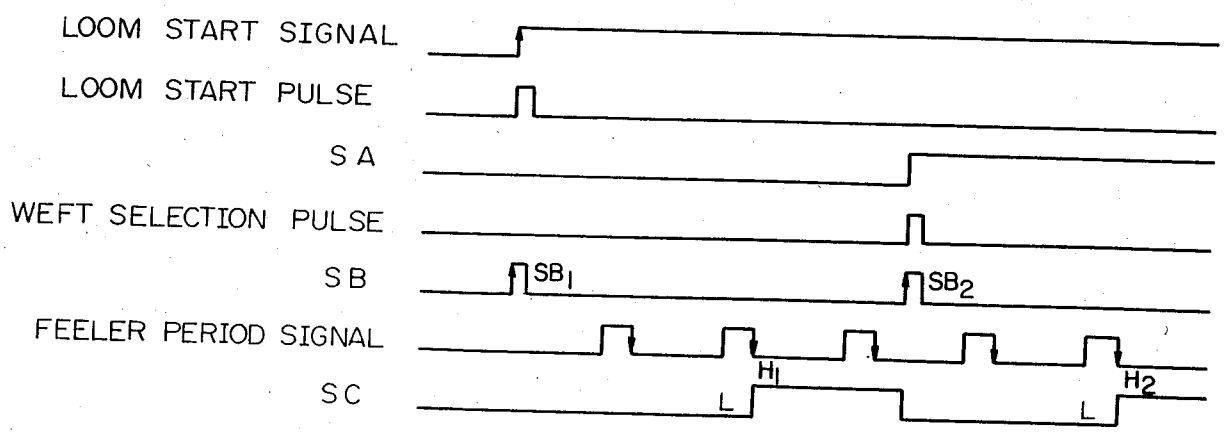
FIG. 3 is a graph for showing time-functional changes of various signals processed in the apparatus of the present invention and, more specifically, shows signal processing through the circuit section of FIG. 2.

The preset counter 41 has a DATA terminal connected to the interlock setter 45 and a CK terminal connected to a feeler period detector 60. When the rise of the one-shot signal SB from the one-shot multivibrator 43 is put in a PRESET terminal of the preset counter 41, a reference R1 from the interlock setter 45 is set in the peset counter 41. The feeler period detector 60 issues feeler period signals in the form of a train of pulses as shown in FIG. 3. FIG. 3 depicts a graph which explains signal processing through the circuit section shown in FIG. 2. On receipt of every feeler period signal, the preset counter 41 counts fall of the pulse and counts down from the set reference R1. When an instant count value equals zero, the preset counter 41 issues a signal of, for example, level "H". This signal is passed to the weft detection circuit 50 as a "detection enable signal SC".

The weft detection circuit 50 includes an amplifier 53 for a feeler 51 arranged on the weft arrival side of the loom a comparator 55 which compares the amplified detection signal SD with a given reference R2. When the amplified detection signal SD falls short of the reference R2, the weft insertion is regarded as unsuccessful and a signal SE of level "H" is issued by the comparator 55 in order to indicate faulty weft insertion. The comparator 55 is connected to an AND gate 57 which accept this faulty weft insertion indicative signal SE and the detection enable signal SC from the preset counter 41. The AND gate is also connected to the feeler period detector 60.

The AND gate 57 issues a loom stop signal SF when the feeler enable signal SC from the detection interceptor circuit 40 is at level "H" and the faulty weft insertion indicative signal SE is put in by the comparator 55 during the feeler period sensed by the feeler period detector 60.

When a weft selection signal SA for weft exchange is issued by the weft selection circuit 30, the one-shot multivibrator 43 accepts the signal to issue a one-shot signal SB which is in turn passed to the preset counter 41. Then the reference R1 from the interlock setter 45 is set in the preset counter 41 which then counts falls of the feeler period signals from the feeler period detector 60 in order to count down from the set reference R1. When an instant count value equals the reference R1 from the interlock setter 45, the preset counter 41 passes a detection enable signal SC to the AND gate 57. No feeler enable signal is put in the AND gate 57 as long as an instant count value exceeds zero so that no AND condition should be established and the AND-gate 57. As a consequence, no loom stop signal is issued by the detection interceptor circuit 50 even when faulty weft insertion signals continue to be issued by the comparator 55.

As is clear from the foregoing, the weft detection circuit 50 is provisionally disenabled over a perdetermined period, e.g., a period of one to two picks following weft exchange so that no loom stop signals should be issued during the picks. Similar situation resides in the starting of a loom. As shown in FIG. 3, signals SB1 and H1 are generated by a loom start signal, whereas signals SB2 and H2 are generated by a weft selection signal. It is thus advantageously employed also that the preset counter 41 should not issue the feeler enable signal over the period of one to two picks after starting of the loom. The embodiment shown in FIG. 2 is designed to this end. In this case, the reset counter 41 accepts, via on OR-gate 49, a loom start signal and/or a weft selection signal. A preset signal is passed to the preset counter 41 from the OR-gate 49 when either of the two signals arrives at the OR-gate 49.

As long as a weaving defect or defects caused by a faulty weft insertion or insertions following weft exchange are within a tolerable limit, the loom is allowed to continue its operation without causing any serious lowering in running efficiency. Accordingly, the weft detection circuit 50 may be disenabled over a different period depending upon the desired quality of the fabric being produced.

I claim:

1. Method for controlling weft detection on a fluid jet loom equipped with a free weft exchanger in which success in weft insertion is detected in response to every feeler period signal and a loom stop signal is issued when faulty weft insertion is detected, comprising the steps of issuing a weft selection signal upon every weft exchange, and allowing issue of said loom stop signal only after a predetermined number of feeler periods from issue of said weft selection signal.

2. Apparatus for controlling weft detection on a fluid jet loom equipped with a free weft exchanger in which success in weft insertion is detected in response to every feeler period signal and a loom stop signal is issued when faulty weft insertion is detected, comprising a weft selection circuit which issues a weft selection signal upon every weft exchange, a feeler period detector which issues said feeler period signal, a detection interceptor circuit which is connected to output sides of said weft selection circuit and said feeler period detector and issues a detection enable signal after a pedetermined number of feeler periods from acceptance of said weft selection signal, and a weft detection circuit which is connected to output sides of said detection interceptor circuit and said feeler period detector and allows issue of said loom stop signal only on acceptance of said detection enable signal.

3. Apparatus as claimed in claim 2 in which said weft selection circuit includes a controller generative of said weft selection signal and a driver which is connected to an output terminal of said controller and operationally coupled to said free weft exchanger.

4. Apparatus as claimed in claim 2 in which said detection interceptor circuit includes a preset counter connected to said feeler period detector, a one-shot multivibrator interposed between said preset counter and said controller of said weft selection circuit, and an interlock setter providing said preset counter with a first reference.

5. Apparatus as claimed in claim 2 in which said weft detection circuit includes a comparator which is connected to a weft feeler of said fluid jet loom and compares a detection signal from said weft feeler with a second reference in order to issue a faulty weft indicative signal in case of faulty weft insertion, and an AND gate which is connected to output sides of said comparator, said feeler period detector and said preset counter of said detection interceptor circuit in order to issue a loom stop signal only when signals from these elements are all present.

* * * * *